US011939755B1

(12) United States Patent
Post

(10) Patent No.: US 11,939,755 B1
(45) Date of Patent: Mar. 26, 2024

(54) PORTABLE PLUMBING-FREE SINK

(71) Applicant: Liliana Post, New Hope, PA (US)

(72) Inventor: Liliana Post, New Hope, PA (US)

( * ) Notice: Subject to any disclaimer, the term of this patent is extended or adjusted under 35 U.S.C. 154(b) by 0 days.

(21) Appl. No.: 18/135,282

(22) Filed: Apr. 17, 2023

(51) Int. Cl.
*E03C 1/186* (2019.01)

(52) U.S. Cl.
CPC ..... *E03C 1/186* (2013.01)

(58) Field of Classification Search
CPC ... A47K 1/02; A47K 1/04; A47K 1/12; A47K 1/05; A47K 1/10; E03C 1/18; A45D 19/04; A45D 19/06; A45D 19/08; A45D 19/10; A45D 19/01
See application file for complete search history.

(56) References Cited

U.S. PATENT DOCUMENTS 175,475 A * 3/1876 Wright ..... A47K 1/02 4/625
1,751,294 A * 3/1930 Spital ..... A47K 1/02 4/626
6,678,902 B1 * 1/2004 Adriano ..... A47K 1/02 4/619
7,802,327 B1 * 9/2010 Moceri ..... A47K 1/02 4/619
8,925,124 B2 * 1/2015 Littlehorn, Sr. ..... A47K 1/02 4/654
11,197,585 B1 * 12/2021 Podemska-Mikluch ..... A47K 1/04
2009/0113618 A1 * 5/2009 Slayton ..... A47K 1/02 4/653
2012/0233769 A1 * 9/2012 Song ..... A61C 17/14 4/625

* cited by examiner

*Primary Examiner* — Erin Deery

(57) ABSTRACT

The present disclosure provides a standalone portable sink assembly that is plumbing-free and suitable for both indoor and outdoor use, with a design that enables more convenient and ergonomic refreshing of the water containers. This is achieved by having a container which is divided into clean and used water container sections by a middle partition. The container is equipped with a pair of handles and detachably combines with a lid having a basin formed therein and extending toward the middle partition to provide a seal therewith and separate clean water section from the used water section.

18 Claims, 19 Drawing Sheets

110

PORTABLE PLUMBING-FREE SINK

CROSS-REFERENCE DATA

The present application claims the benefit and priority of U.S. Provisional Application No. 63/443,475 filed on Feb. 6, 2023, with the same title, U.S. Provisional Application No. 63/333,186 filed on Apr. 21, 2022, and U.S. provisional patent application No. 63/388,586 filed Jul. 12, 2022, the contents of which are incorporated by reference in their perspective entireties.

FIELD OF INVENTION

The present invention generally relates to a sink apparatus. More specifically, the present invention relates to a portable sink apparatus comprising no attachments to a plumbing system and having a clean and used water container system configured for ergonomic operation and water removal.

BACKGROUND

A portable plumbing-free sink can be advantageous for a variety of reasons. Firstly, it provides a convenient solution for those who are on the go or in temporary locations, such as outdoor events or campgrounds. With a portable sink, there is no need to rely on traditional plumbing systems, which can be costly, time-consuming, and sometimes not possible to install. Additionally, having a portable sink allows for greater flexibility in terms of placement, as it can be easily moved to different areas as needed. This can be particularly useful for people who are bedridden. Furthermore, a portable sink can help maintain hygiene standards by providing a readily available source of clean water for handwashing and other sanitary purposes. Overall, a portable plumbing-free sink is a convenient and practical solution for a variety of situations and can provide numerous benefits in terms of convenience, flexibility, and hygiene.

More specific scenarios where a portable sink can be a useful solution in situations where traditional plumbing is not available or practical:

- Home use: They can be quickly set up in garages, basements and other rooms that are usually not equipped with traditional sinks. The portable sinks can also be placed at an ideal height for children, who cannot reach the traditional sinks, to use.
- Schools and daycares: They can be set up in classrooms, playgrounds and other areas that eliminates the need for caretakers to separately accompany young children to traditional sinks, saving time and effort.
- Outdoor activities: They are ideal for use at campsites, backyards, parks, and other outdoor locations where plumbing is not available.
- Construction sites: They can be used to provide workers with a convenient way to wash their hands and maintain good hygiene.
- Remote or rural areas: They can be used in areas where access to plumbing is limited or non-existent.
- Emergency preparedness: They can be used to maintain sanitation and hygiene for people affected by natural disasters or other emergencies.
- Medical facilities: Portable sinks can be used in hospitals, clinics, and other medical settings to provide patients and staff with a convenient and easy way to wash their hands.

Many inventors have tried creating sinks that meet those needs. However, the current designs are often overly complicated that inadvertently restrict their usage, limit the water capacity, and/or do not allow for easy cleaning and maintenance of the device. Therefore, the need exists for a portable and easy to use sink that can be universally used for the various purposes described above.

SUMMARY

The design presented here strategically abides by "less is more" philosophy. The design comprises two large single-piece parts, namely a container and a container lid, with various features of the portable sink incorporated into these two pieces. The clean and used water containers are both formed as a part of the container to enable users to drain and refill the water in just one effort. Not only does the "less is more" design makes it very easy to clean, it also allows the users to use the sink based on how they see fit. The flat and open shelf space next to the basin incorporated into the container lid gives users the flexibility to store any accessories, such as toothbrushes, soap dispensers, and cutting utensils, that all vary in size. The refill and drain holes also enable users to insert an external water hose of the water pump and spout assembly and leave both holes open for continuous inflow and outflow of water, which is suitable in an outdoor setting.

Although simple, the sink is carefully constructed so it can be ergonomically lifted from and placed into the opening of a table, which adds desired height and extra space. Alternatively, the sink may be used by itself or placed on the table or another common supporting structure. This configuration is ideal when creating a wash station for young children who cannot reach the traditional sinks at home.

In addition, the middle partition that runs horizontally from left to right in the container to separate the clean water section from the used water section helps distribute the weight equally between both arms when carrying the sink. The container size has been extensively tested to strike the right balance between having an adequate water supply and the sink not being too heavy for an average adult to carry.

While many plumbing-free sink designs exist, the design presented here offers users a powerful tool that is a versatile, practical, and effective.

The present invention describes a portable sink apparatus having a container with a bottom that is divided into a clean water section and a used water section by a middle partition. The container is fitted with a pair of handles on the left side and the right side. The container is combined with a detachable lid, which incorporates a basin. The assembly of the container and the container lid can be lifted out of an optional frame or from a surface and taken to a water discharge and refill point using the handles, optionally supplemented with one or more wheels. The container lid may further include a water intake protrusion at the back side thereof configured to accept the electric pump and water dispenser assembly when placed over the water intake protrusion with the water inlet hose traversing therethrough and extending to the clean water section of the container. The basin may further include a drainage opening at the lowest point of the basin and located above the used water section of the container.

In some embodiments, the container may further comprise an upper rim along the top end thereof configured to facilitate placing the portable sink assembly vertically through and retaining it within a rectangular cut-out opening of a supporting structure.

In some embodiments, the container and/or the container lid may further comprise a pair of handles on both sides thereof.

In some embodiments, the used water section may be sized to have at least the same or greater internal volume than the clean water section.

In some embodiments, the container may further comprise a drainage opening with a removable cover located at the lowest portion of the used water section thereof and configured to facilitate the removal and disposal of used water therefrom.

In some embodiments, at least one of the single-piece container or the single-piece container lid may be made from plastic, for example, by thermoforming and/or injection molding manufacturing methods.

In some embodiments, the sink assembly may further comprise a match-and-lock pair of elements, with a first match-and-lock element formed as part of the single-piece container and the second match-and-lock element formed as part of the single-piece container lid, wherein the match-and-lock pair of elements are configured to allow only one correct way to position the container lid over the container.

In some embodiments, upon assembly of the container lid over the container, the middle partition of the container may be removably engaged with a corresponding protrusion of the container lid to sealingly isolate the clean water section from the used water section.

The clean water container section may also be provided with a pluggable inlet configured to enable the refilling of the clean water container even with the container lid covering it. In alternative embodiments, the lid may comprise the pluggable inlet on the top surface for refilling. In either type of embodiment, the sink may also comprise a funnel for directing the water into the inlet.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

Figure 1:
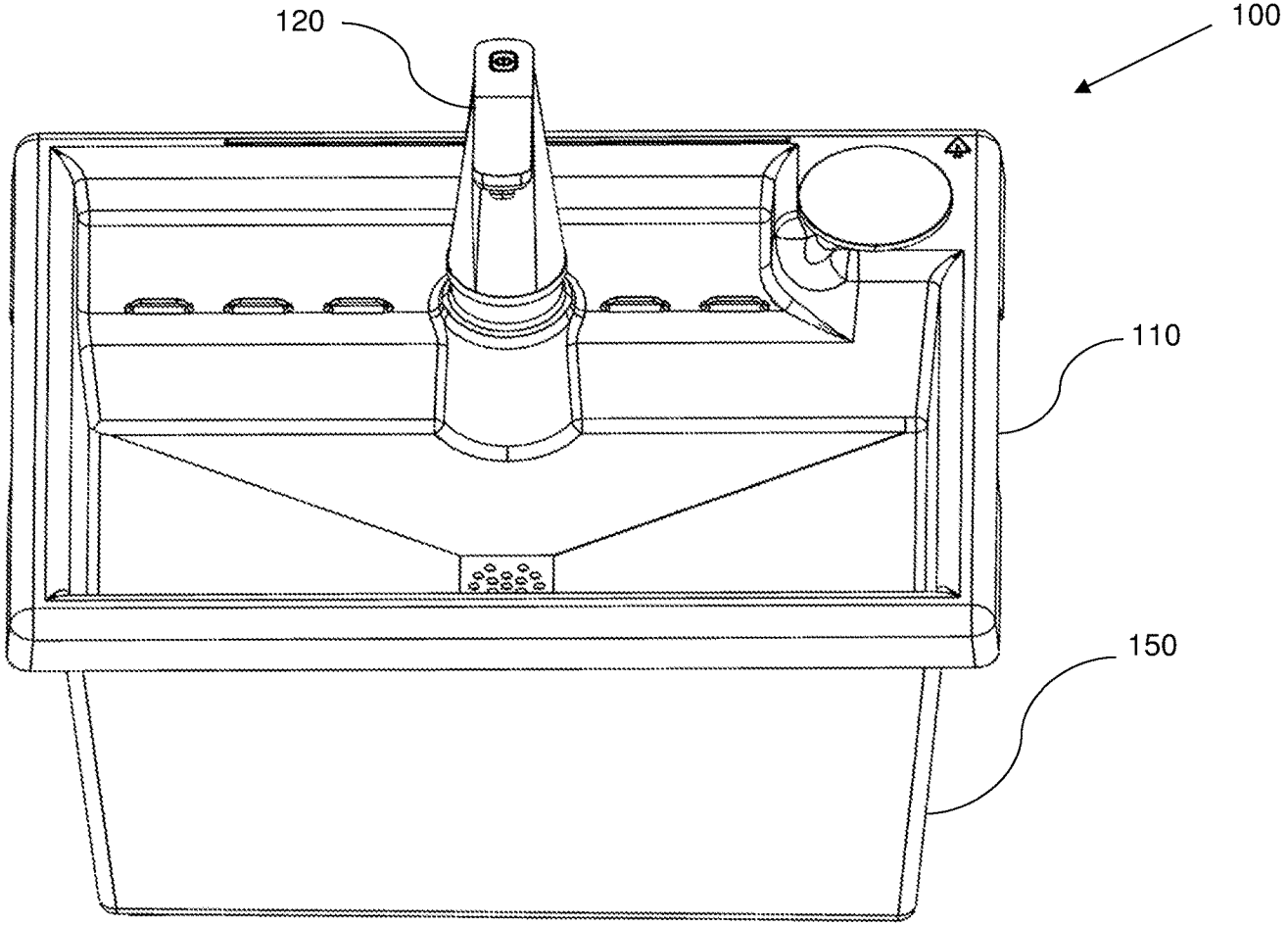
FIG. 1 illustrates a perspective view of an exemplary configuration of a portable plumbing-free sink apparatus according to the present disclosure.
Figure 2:
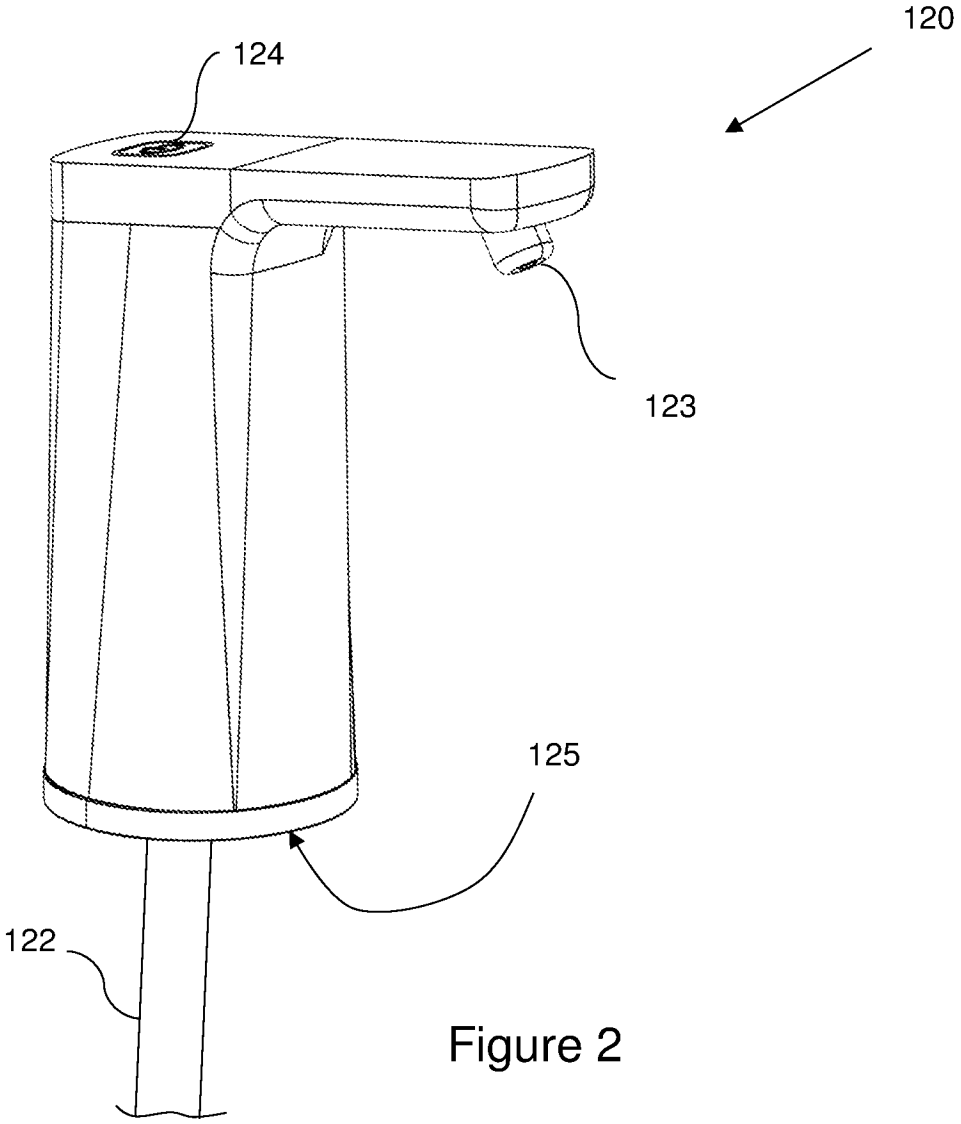
FIG. 2 illustrates a perspective view of the battery-operated electric pump and water dispenser assembly having an inlet hose.

Common reference numerals are used throughout the figures and the detailed description to indicate like elements. One skilled in the art will readily recognize that the above figures are examples and that other architectures, modes of operation, orders of operation, and elements/functions can be provided and implemented without departing from the characteristics and features of the invention, as set forth in the claims.

DETAILED DESCRIPTION AND PREFERRED EMBODIMENTS

The following is a detailed description of exemplary embodiments to illustrate the principles of the invention. The embodiments are provided to illustrate aspects of the invention, but the invention is not limited to any embodiment. The scope of the invention encompasses numerous alternatives, modifications, and equivalents; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

The present disclosure provides a novel design for a versatile portable sink apparatus that can be used indoors and outdoors, and that is also suitable for use by both children and adults. The sink design is based on using a partitioned container with clean and used water sections and ergonomic handles on either edge, the container coupling directly with a lid that includes a basin. This core concept leads to a plumbing-free sink that is truly portable, easy to refill and clean.

Several exemplary implementations of the disclosed sink apparatus are provided with reference to the accompanying illustrations. The specific constructions of each example are meant only as illustrative implementations and should not be construed as limiting either the structure or the applications of the disclosed sink apparatus.

Referring to FIGS. 1 through 5, the exemplary design of the portable sink apparatus 100 is shown. As can be seen, sink apparatus 100 generally comprises a container 150 and a container lid 110. The water dispenser assembly 120 may be detachably or permanently positioned over a corresponding feature of the lid 110. The water dispenser assembly is seen in greater detail in FIG. 2 and may be equipped with a manual or battery-operated water pump configured to cause water to flow from the intake hose 122 and out of the spout 123 extending over the sink 118. The water pump may be activated by a button 124, which may be located on top of the water dispenser assembly or in another easily reachable place. In other embodiments, the water dispenser assembly 120 may be operated in a touchless mode by using a proximity sensor, as the invention is not limited in this regard. The intake hose 122 may be selected to be sufficiently long and be routed to reach the bottom of the clean water section of container 150, as described in greater detail below. In further embodiments, a manually operated pump may also be used, with activation achieved by pushing a lever or compressing a spring to cause water intake and dispensing through the spout 123.

Figure 3:
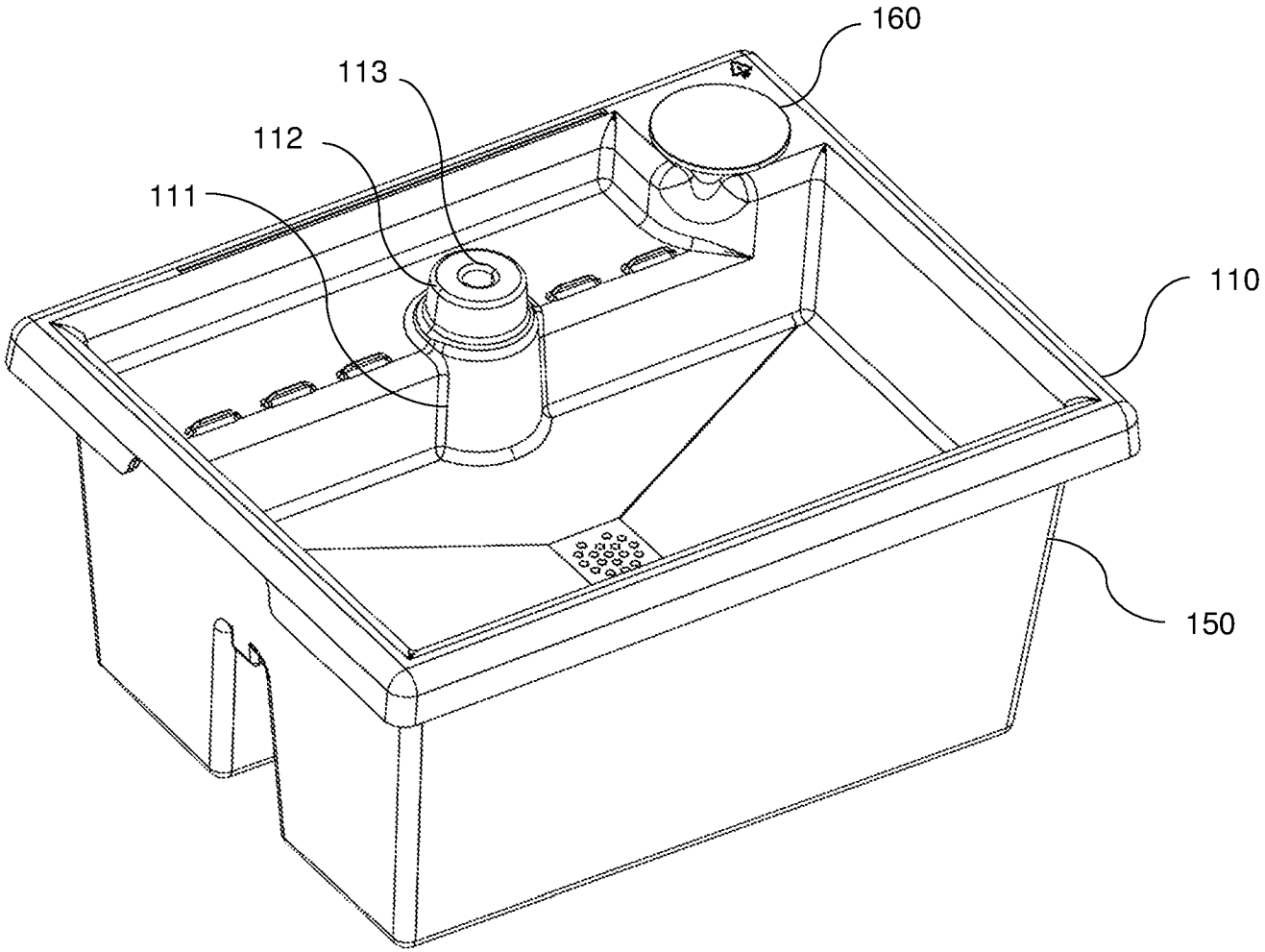
FIG. 3 illustrates a sink assembly in a stand-alone configuration without the electric pump and water dispenser assembly.
Figure 11:
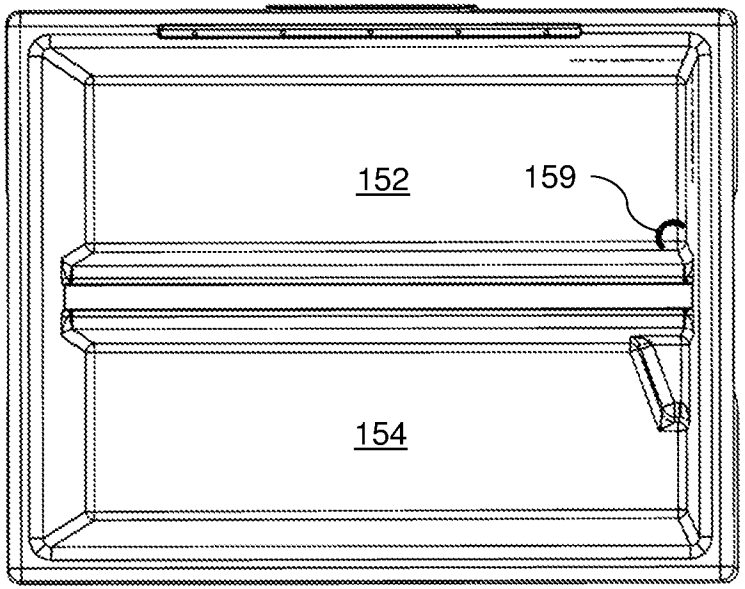
FIG. 11 shows a top view of the container.
Figure 16:
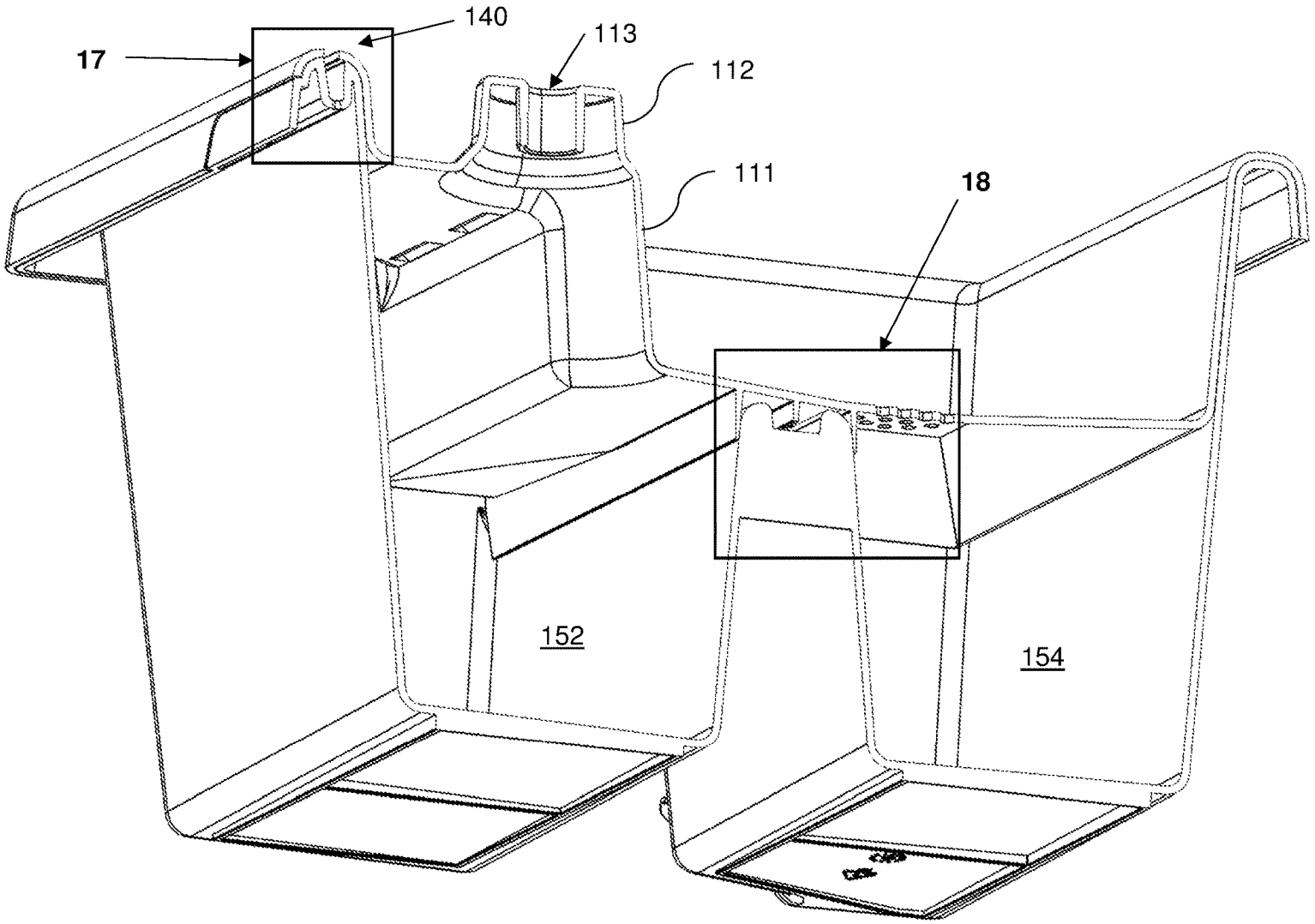
FIG. 16 shows a perspective view of the container with a container lid in cross-section.

One suitable way to detachably position the water dispenser assembly 120 is to place it on top of a tapered head 112 formed as part of the water intake protrusion 111 in the center of the back portion of the container lid 110—see FIG. 3 and FIG. 16. Alternatively, the tapered head and the water dispenser may be positioned on a side of the portable sink 100, as the invention is not limited in this regard—as long as this position is generally over the clean water section of the container 150. The internal opening 125 at the bottom of the water dispenser assembly 120 may be selected to match the tapered shape of the head 112 so as to form a friction fit when the dispenser assembly 120 is placed on top of the tapered head 112. The intake hose 122 may fit through a central opening 113 located above the clean water section 152 of the container 150 when the dispenser assembly 120 is positioned in place as described above. A tubing holder 159 (as seen in FIG. 11) may be used to retain the feeding end of the intake hose 122 near the bottom of the clean water section 152. A number of commercially available water dispenser assemblies may be used for the purposes of the present invention; many of them have a suitable internal opening 125 sized to allow placement of the water dispenser assembly 120 over the tapered head 112.

Figure 4:
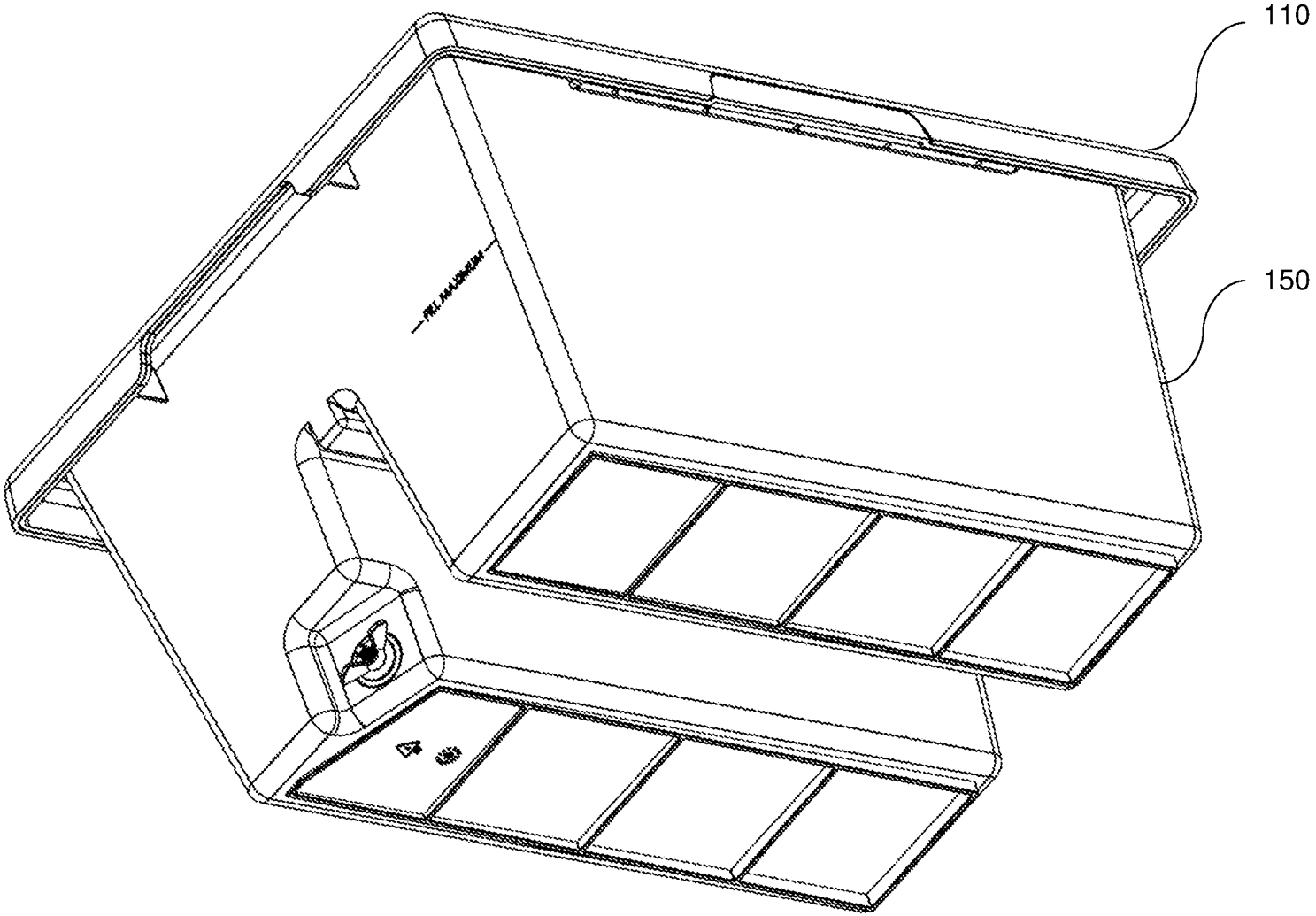
FIG. 4 shows the same in a perspective view from the bottom.
Figure 5:
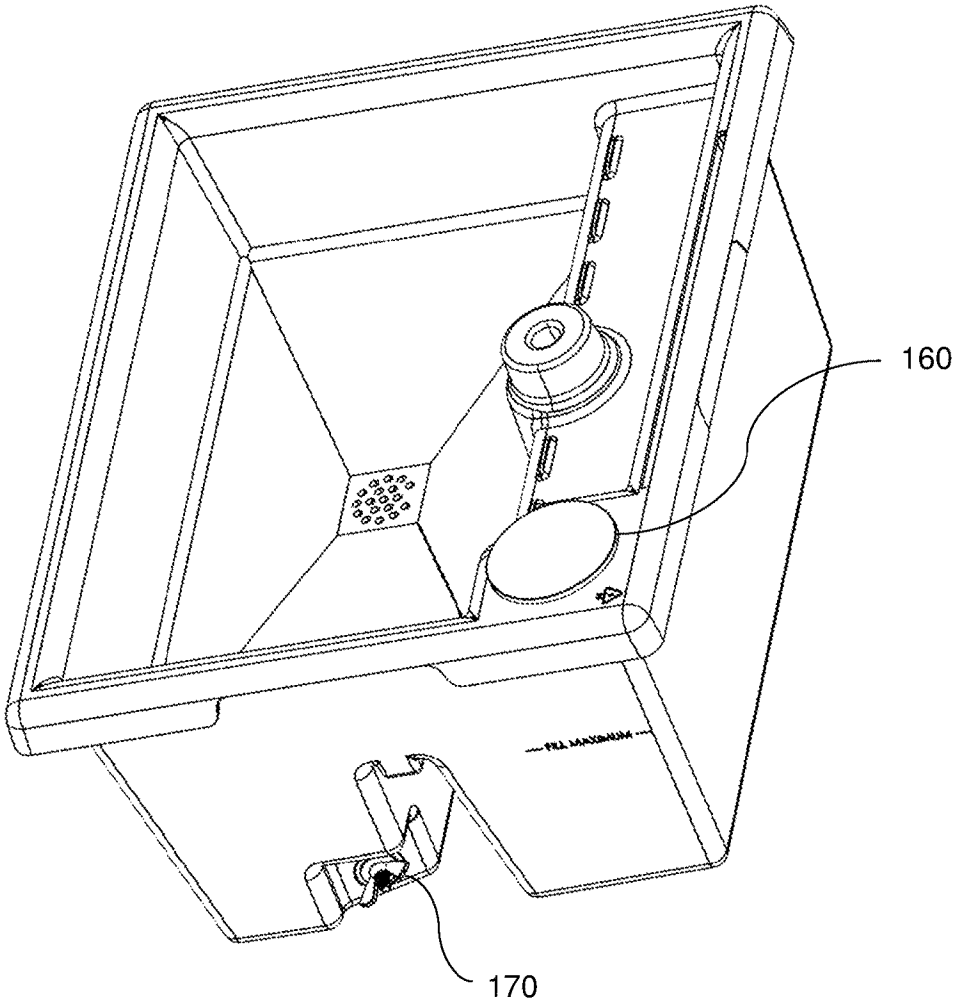
FIG. 5 shows a perspective bottom view of the same from the top.

FIGS. 3 through 5 show the assembly of the container 150 and the container lid 110 from various viewpoints. The container 150 is seen by itself in FIGS. 8 through 11. It may be made as a single piece of plastic in a manner similar to that of the container lid 110, for example using thermoforming, injection molding, or other suitable manufacturing techniques. The container 150 and/or the container lid 110 may be made from a suitable plastic material to allow for the use of common manufacturing techniques, such as polypropylene, polycarbonate, polyethylene, or alike. In some embodiments, either a container 150 and/or the container lid 110 may be made from a clear or at least a translucent material to allow for easy monitoring of the water levels inside the container 150.

The container 150 may have an open top and may be divided into a clean water section 152 and a used water section 154 by a middle partition 156. The container 150 may have a generally rectangular shape with a width W greater than a length L when facing a user—see FIG. 9. The middle partition 156 may be oriented along the width of the container 150 from the left side of the container to the right side thereof. The partition 156 may have one or a series of spaced apart reinforcement ribs 158 (see FIG. 9) to further strengthen the container 150. The clean water section 152 may be located further away than the used water section 154 when facing a user. The height of the middle partition 156 may extend all the way from the bottom of the container 150 to the bottom of the basin 118 when the lid 110 is placed over the container 150. This may be done to separate the clean water section 152 from the used water section 154. In further embodiments, the bottom of each water section may be slanted towards the middle partition so as to cause water accumulation towards the center of gravity of the container 150, which may make it easier to handle for the user. The bottom 155 of the used water section 154 may be further slanted towards one side thereof so as to make it easier to drain the water therefrom when the drainage opening 155 is located at the lowest point of the used water section 154. The drainage opening 155 may be equipped with a removable cap or plug assembly 170 so as to facilitate water drainage therefrom.

The container 150 may be sized to accept anywhere between 1 and 10 gallons of water in either one of the clean water section 152 and used water section 154. In embodiments, each section 152 and 154 may be sized to accept up to 1 gallon, up to 2 gallons, up to 3 gallons, up to 4 gallons, up to 5 gallons, up to 6 gallons, up to 7 gallons, up to 8 gallons, up to 9 gallons, or up to 10 gallons of water.

Figure 7:
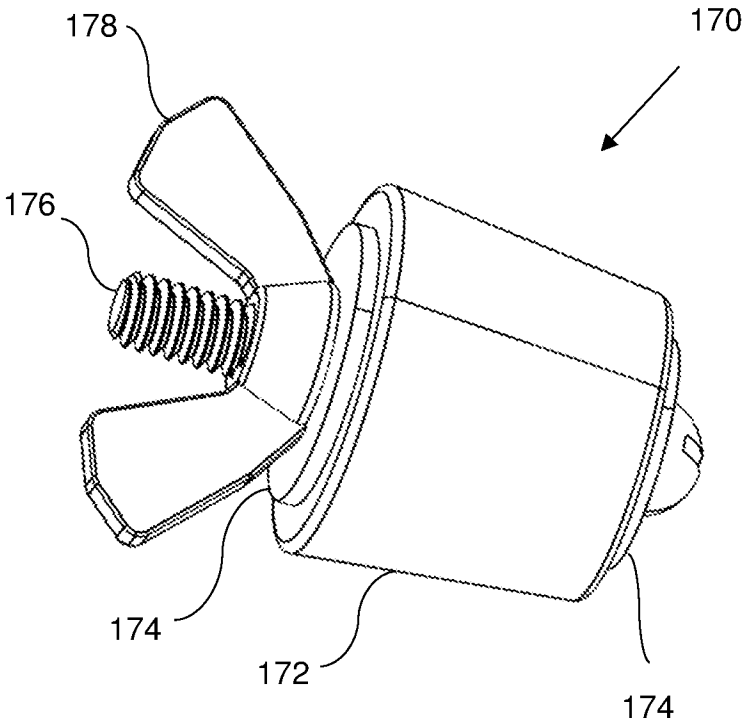
FIG. 7 shows a perspective view of the exemplary drain plug assembly.

The drainage plug 170 may be a suitably shaped tapered plug made from a single solid material, such as silicone. In other embodiments, the drainage plug 170 may be an assembly of components as seen in FIG. 7. It may include a central screw 176 with a wing nut 178 compressing an elastic body 172 between two metal washers 174. One advantage of using this assembly 170 is the ability to adjust the diameter of the plug 170 to make it tighter if needed.

The container 150 may have a container rim 151 around the periphery of the open top thereof. The container rim 151 may have two cut-outs 153 forming a pair of handles on the left side and the right side of the container 150—see FIGS. 8 and 9.

Figure 17:
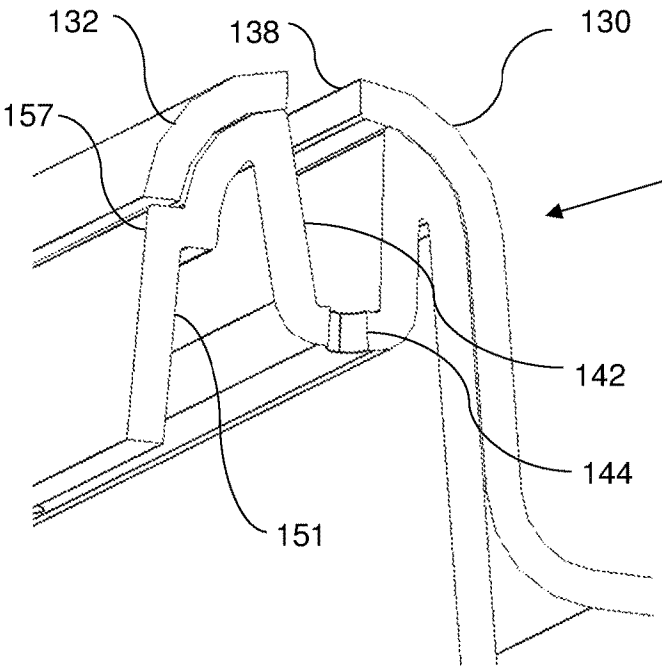
FIG. 17 shows a close-up of the mirror holder detail of the container and the container lid.

The container lid 110 is now described with reference to FIGS. 12 through 15. The container lid 110 may further have a lid rim 130 extending along the periphery thereof and configured to go over a corresponding rim 151 of the container 150 so as to form a closed assembly when the lid 110 is placed over the container 150. Cut-outs 131 may be made on both the left side and the right side of the rim 130 of the container lid 110. Together with cut-outs 153, they may form a pair of handles suitably shaped to facilitate the lifting and carrying of the sink assembly from one place to another. In some embodiments, the lid 110 may be configured to be sealingly placed over the container 150 so as to avoid water leak along the rim of the lid. In further yet embodiments, the rim of the lid 110 and the rim of the container 150 may be equipped with a match-and-lock pair of elements 132 and 157 (FIG. 17)—such that the first match-and-lock element 157 is formed as part of the single-piece container 150 and the second match-and-lock element 132 is formed as part of the single-piece container lid 110. The match-and-lock pair of elements 132 and 157 may be configured to allow only one correct way to position the container lid 110 over the container 150, such as, in one example, by being both located only along the back portion of the container 150 and the container lid 110. This design may be used to ensure that the lid 110 can be placed over the container 150 in only one way—so that locations of the intake hose 122 and the drainage opening 115 are appropriate for their respective functions relative to the clean and used water sections 152 and 154 of the container 150.

Figure 12:
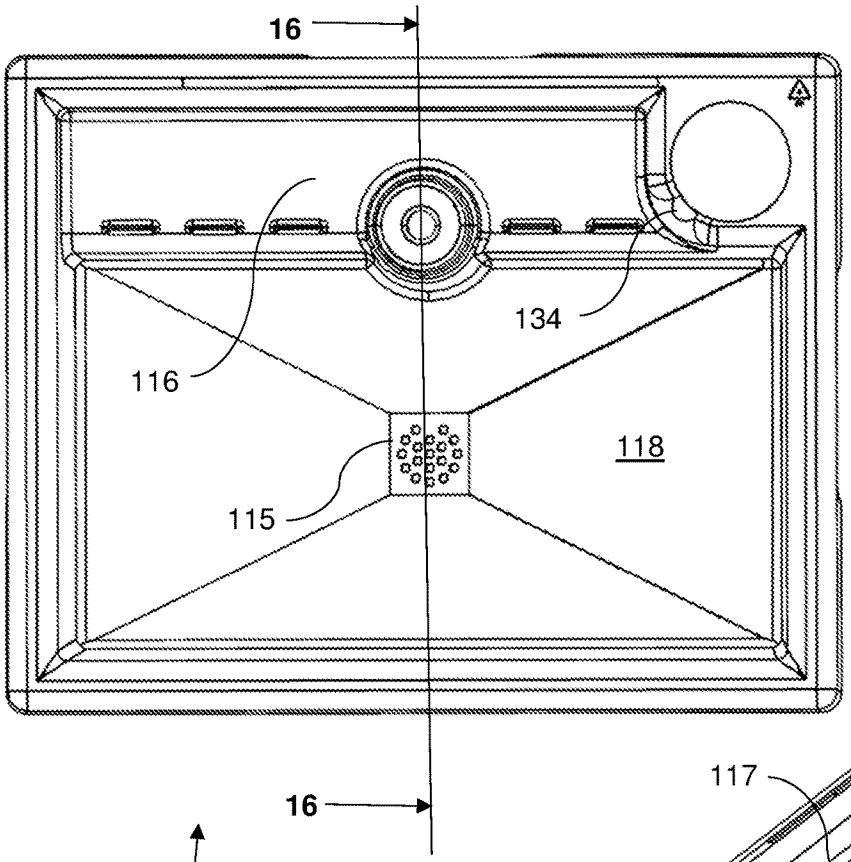
FIG. 12 shows a top view of the container lid.
Figure 13:
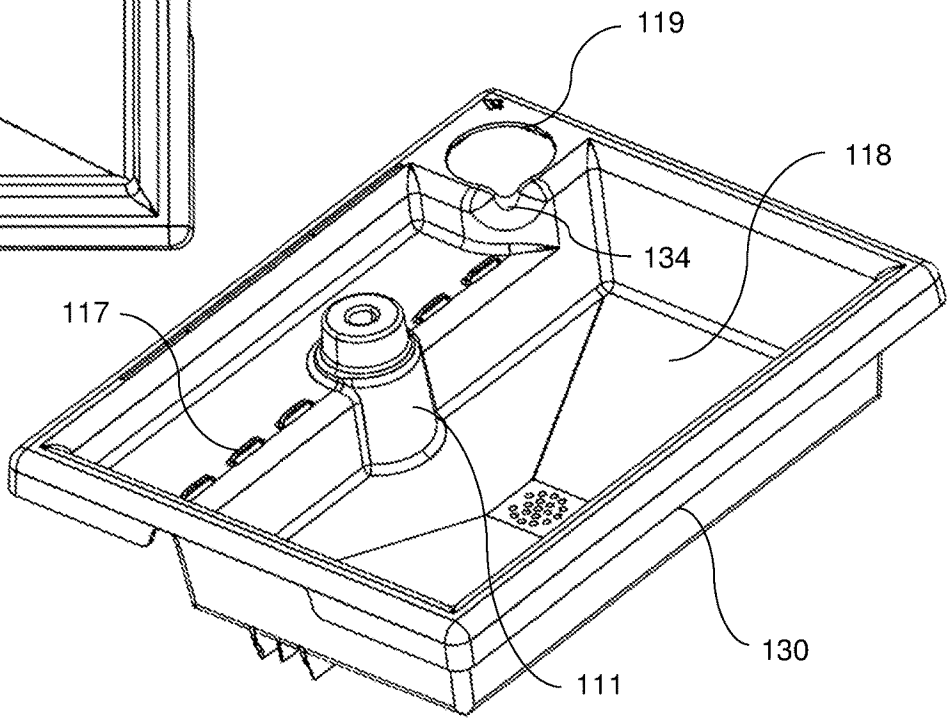
FIG. 13 shows a side perspective view of the container lid.

The container lid 110 may have a built-in basin 118 formed to extend downward therefrom in the front portion of the container lid closest to the user, leaving an optional shelf 116 for placing soap, toothbrushes holder, etc.—see FIGS. 12 and 13. The flat shelf 116 may be further separated from the basin 118 by a series of ridges 117 designed to allow extra water to drain through but prevent any items placed on the shelf 116 from falling into the basin 118.

The basin 118 may further include a drainage opening 115 having a plurality of drainage holes and located at the lowest point of the basin 118 and above the used water section 154 of the container 150.

Figure 6:
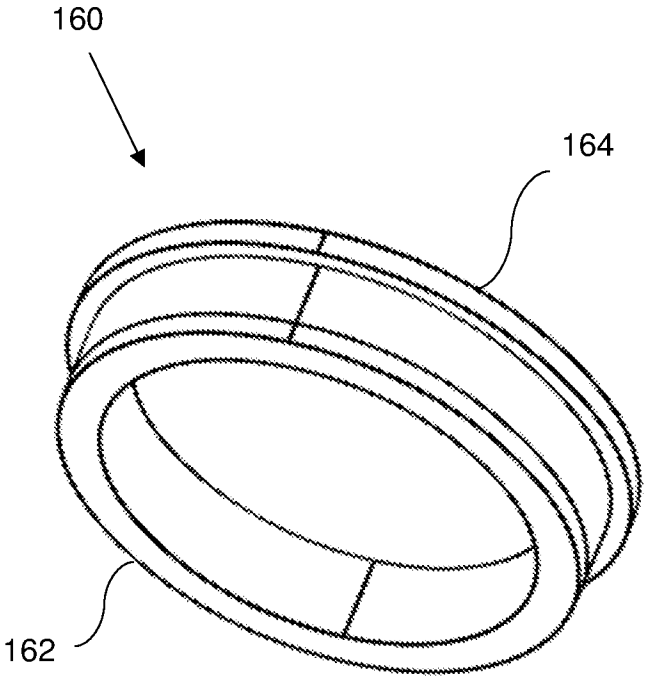
FIG. 6 shows a perspective view of the water inlet plug.
Figure 9:
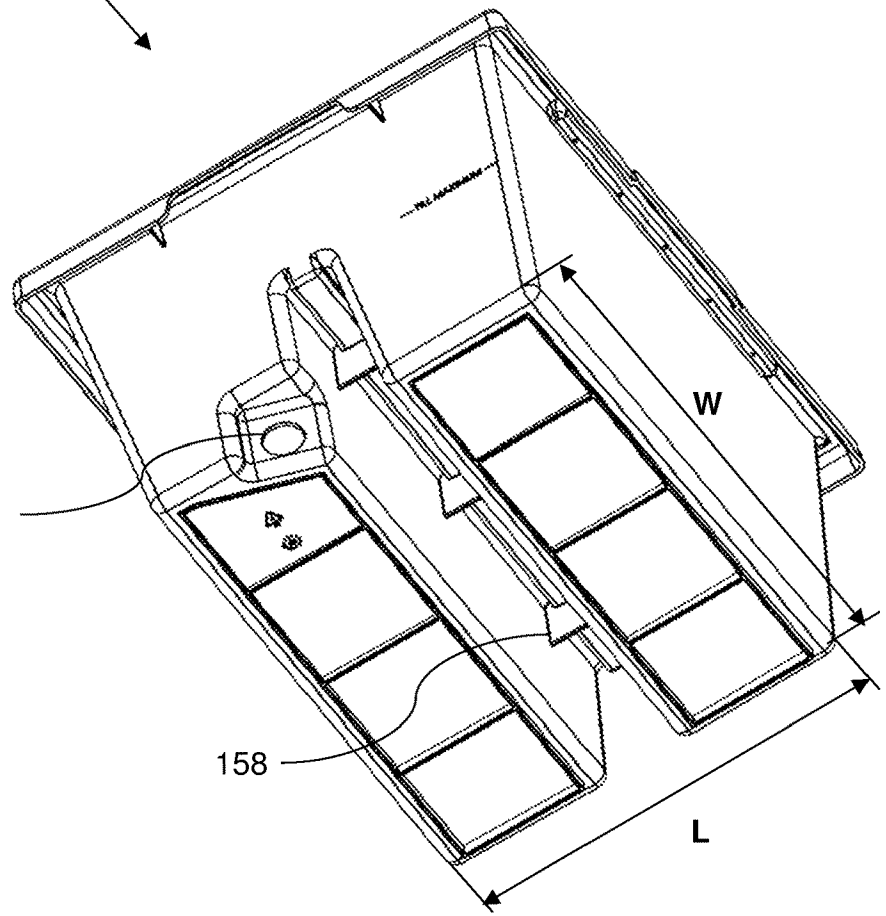
FIG. 9 shows a perspective bottom view of the same.
Figure 8:
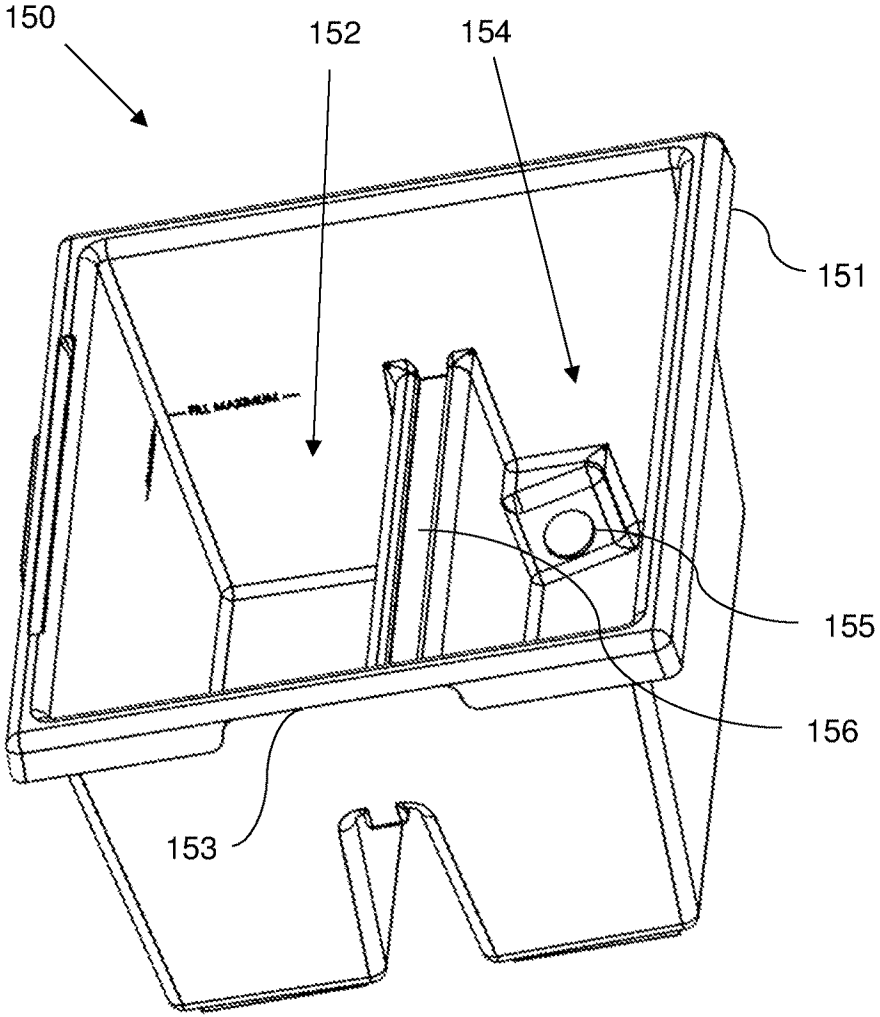
FIG. 8 illustrates a perspective top view of the container.
Figure 10:
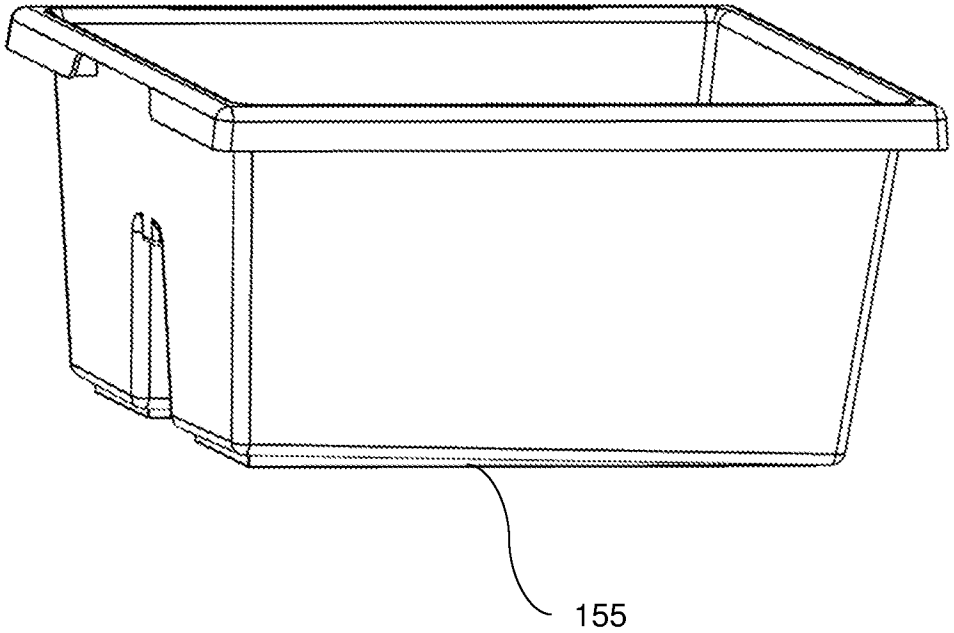
FIG. 10 shows a perspective side view of the container.

The container lid 110 may also include an opening 119 located, for example, in one of the back corners of the lid 110 above the clean water section 152 of the container 150—see FIG. 13. The opening 119 may be configured to be wide enough to facilitate water refill of the clean water section 152 without removing the lid 110 from the container 150. In further embodiments, the opening 119 may be provided with a removable cap 160 having a rim 164 and a body 162 (see FIG. 6) so as to avoid used water from entering the opening when the sink is in use. The size of the opening 119 may be sufficiently large to allow pouring clean water therein without the use of a funnel. To facilitate easy removal of the cap 160, a depression 134 may be made to allow easy reach under the rim 164 when the cap 160 is positioned in place.

Figure 14:
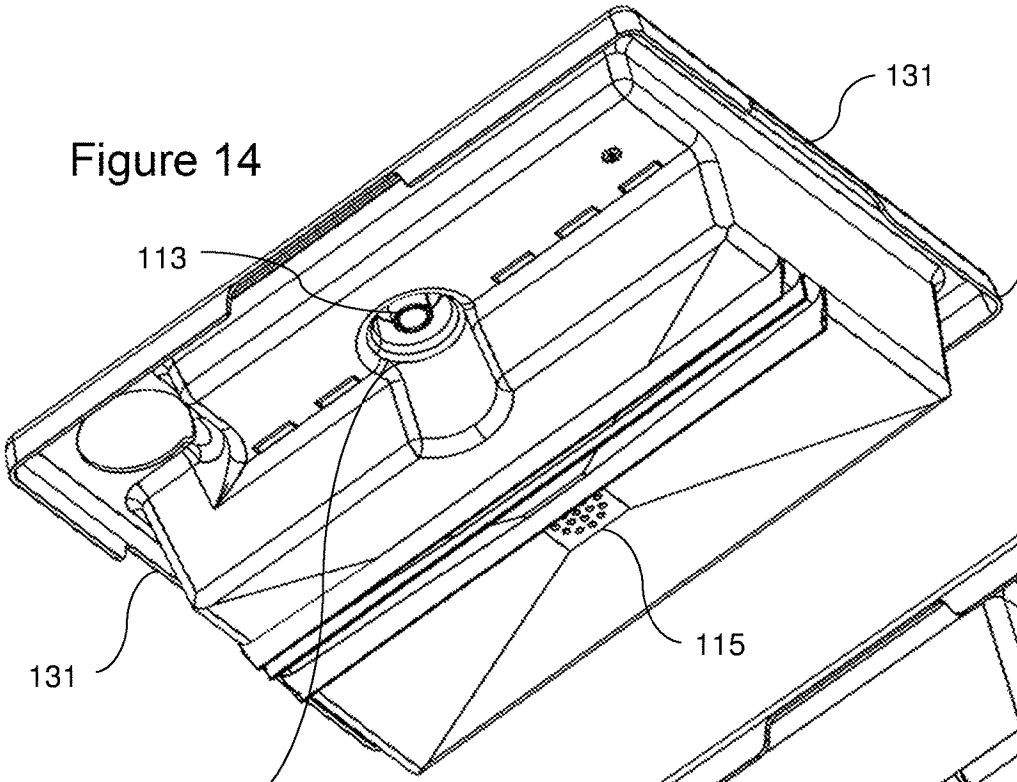
FIG. 14 and FIG. 15 show two alternative perspective views of the container lid from the bottom.
Figure 15:
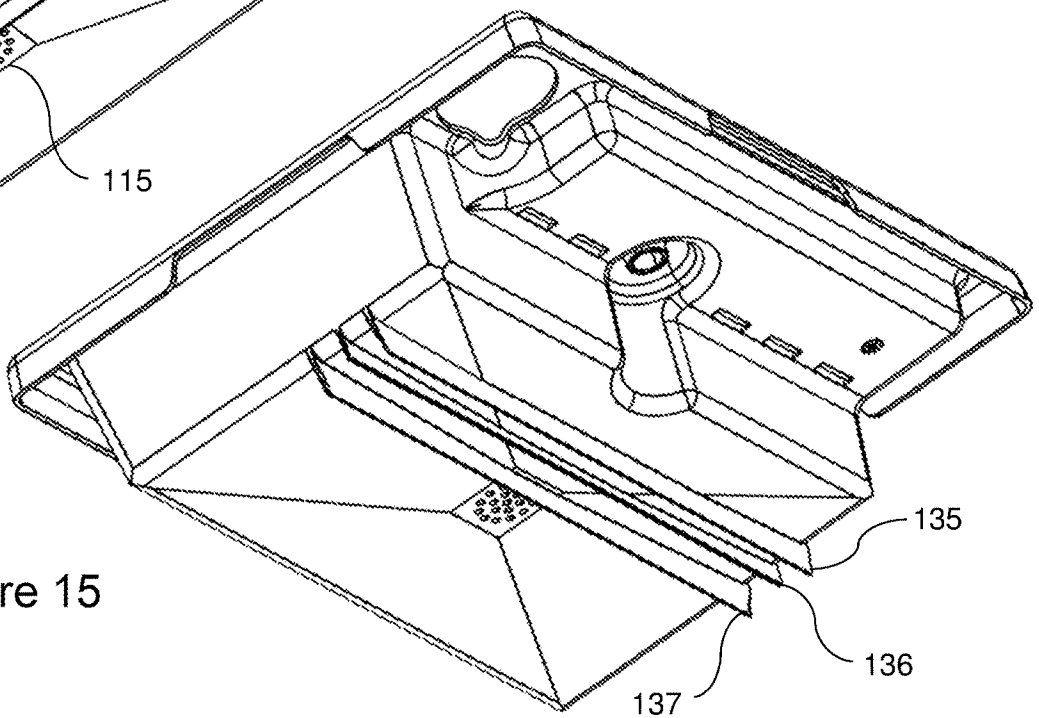
Figure 18:
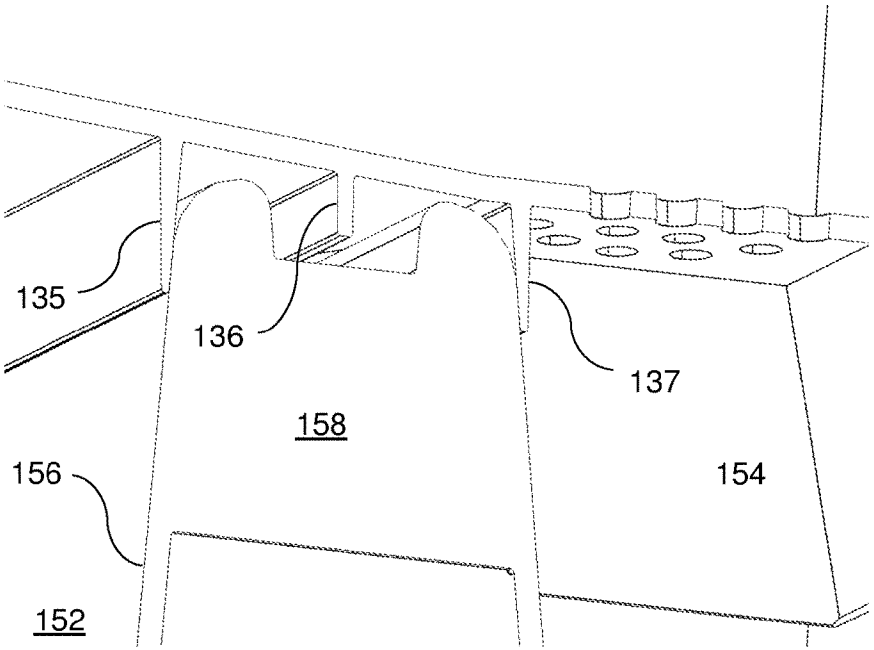
FIG. 18 shows a close-up of the seal between the container and the container lid separating the clean water section from the used water section.
Figure 26:
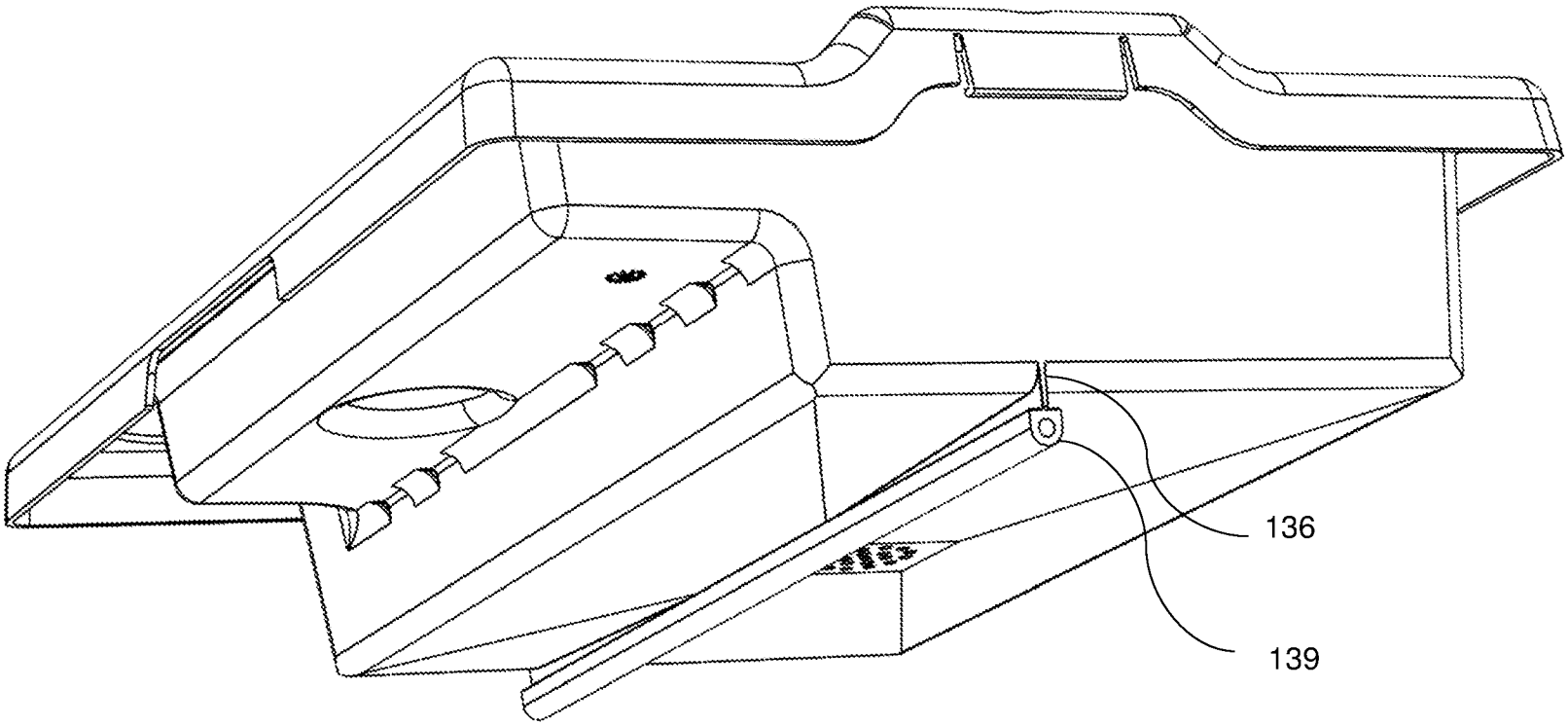
FIG. 26 is a perspective bottom view of the container lid of the alternative embodiment.

FIGS. 14 and 15 illustrate a series of three parallel sealing protrusions 135, 136, and 137 located on the bottom of the basin 118 facing the middle partition 156. In embodiments, at least sealing protrusion 135, or a plurality of sealing protrusions 135, 136, 137 may be provided to engage with the middle partition 156 and to sealingly separate the clean water section 152 from the used water section 154 when the lid 110 is placed over the container 150. A close-up of the sealing arrangement is seen in FIG. 18. In further embodiments, at least one or several sealing protrusions may have a compressible gasket attached thereto and facing the middle partition to further enhance the quality of the seal between the container and the container lid and separation of the clean water section from the used water section of the portable sink 100. FIG. 26 shows an example of providing one sealing protrusion 136 with a compressible gasket 139 located on the end of the sealing protrusion facing the middle section 156. The compressible gasket may be made from suitable elastic materials such as made from food-grade rubber or polymer material and may optionally contain a void to assist in compressing the gasket when in use.

Figure 19:
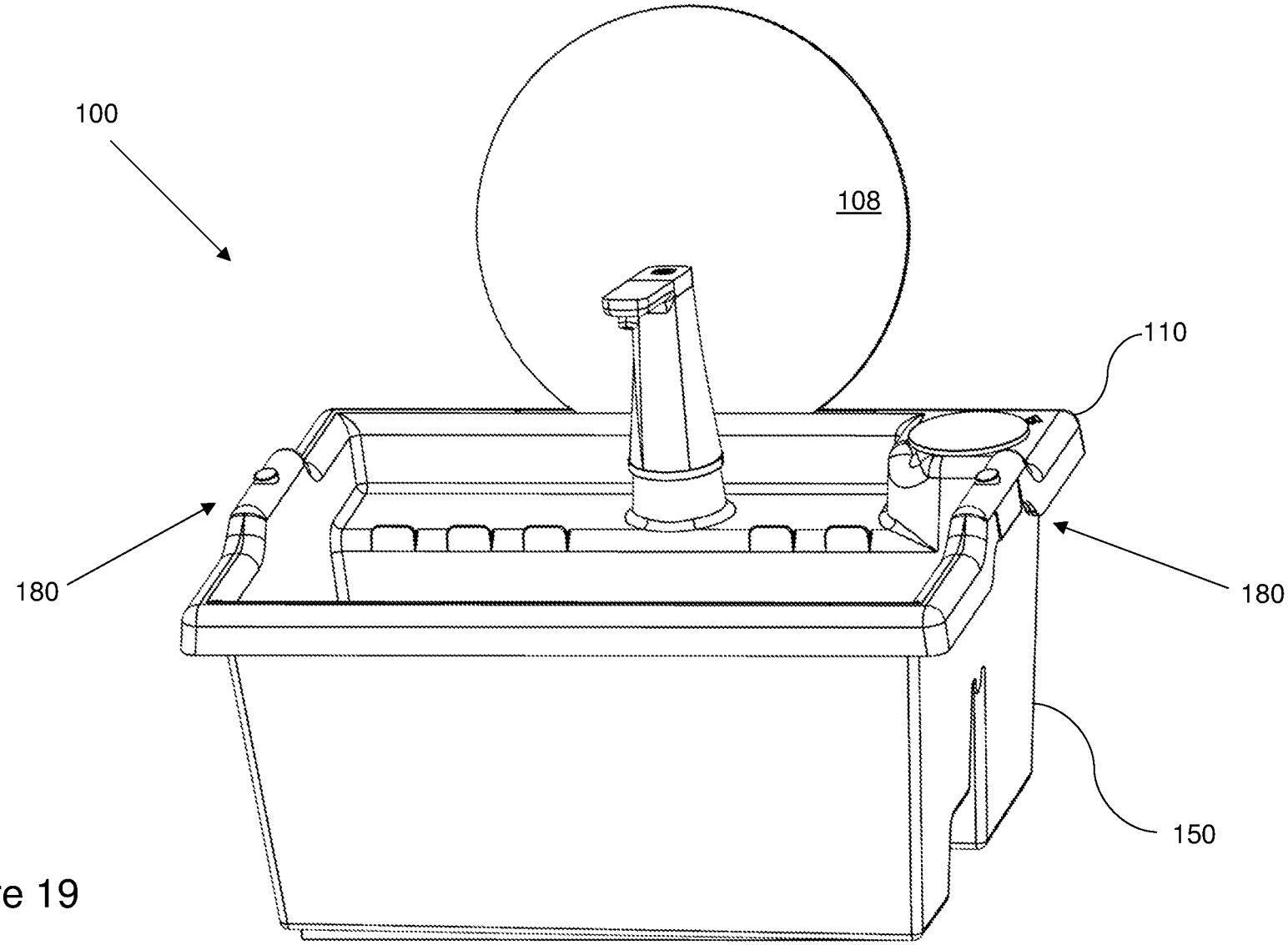
FIG. 19 is a perspective view of an alternative embodiment of the portable sink of the present invention.
Figure 21:
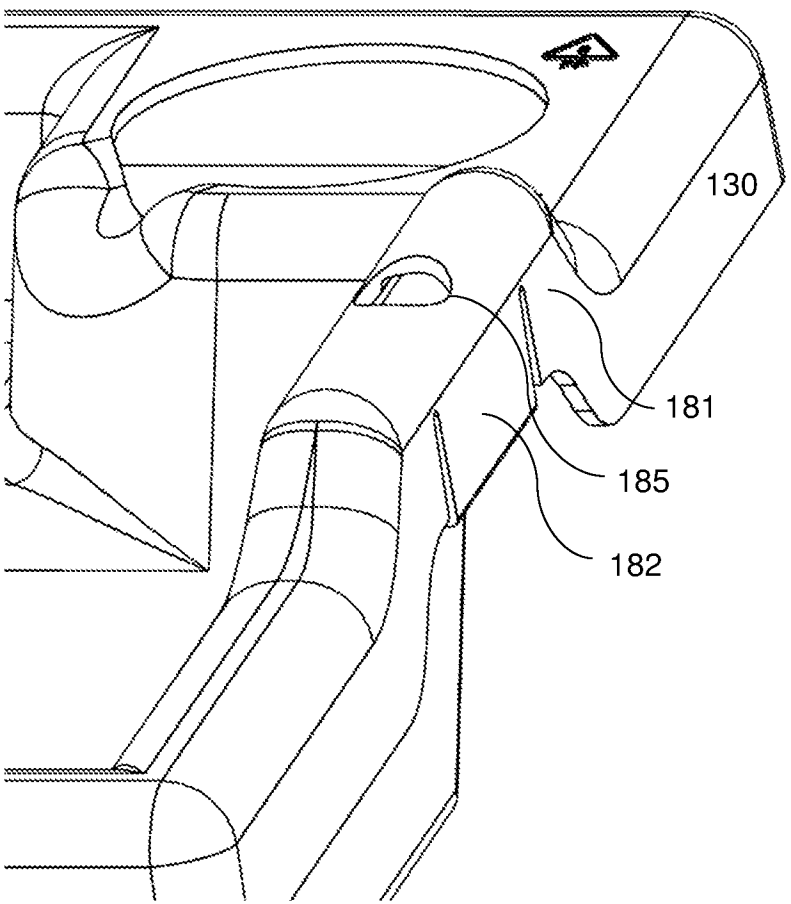
FIG. 21 is the same view of the container lid only.
Figure 20:
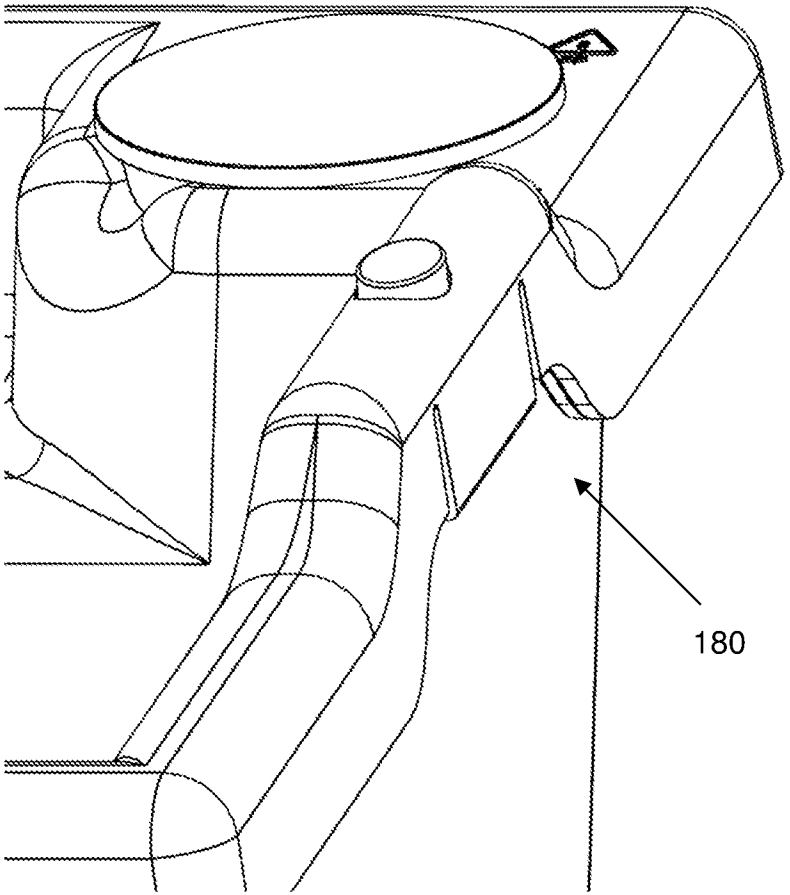
FIG. 20 is a close-up perspective view of a handle section of the sink apparatus.
Figure 22:
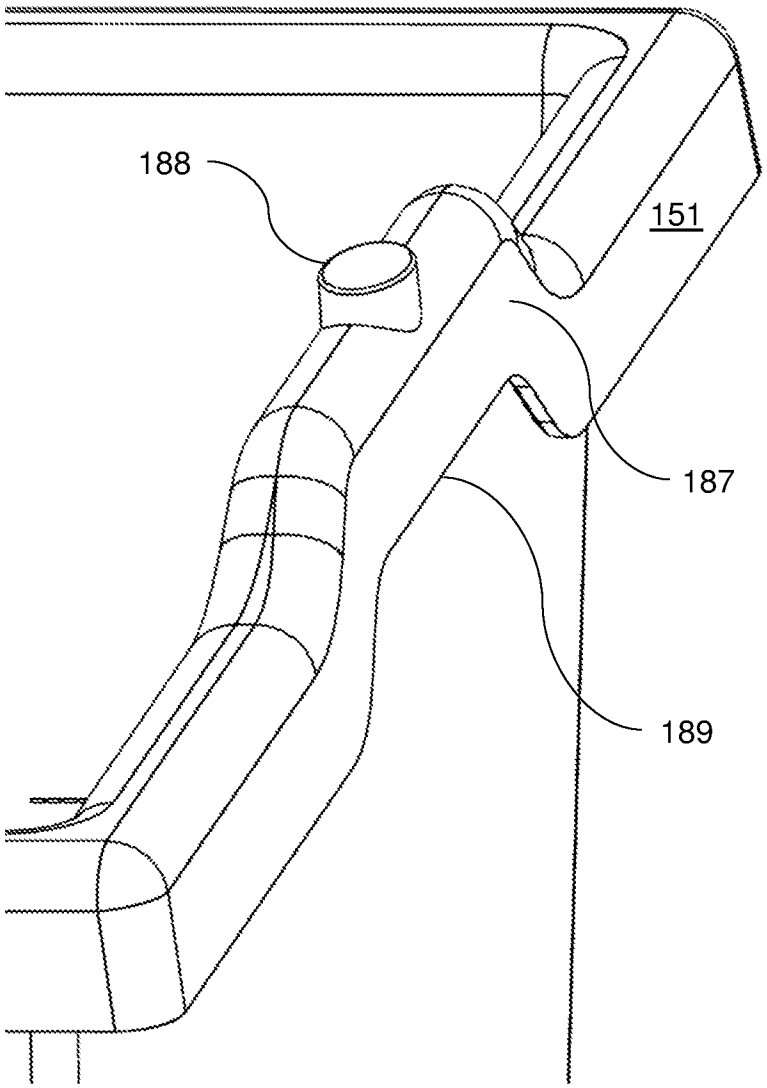
FIG. 22 is the same view of the container only.
Figure 24:
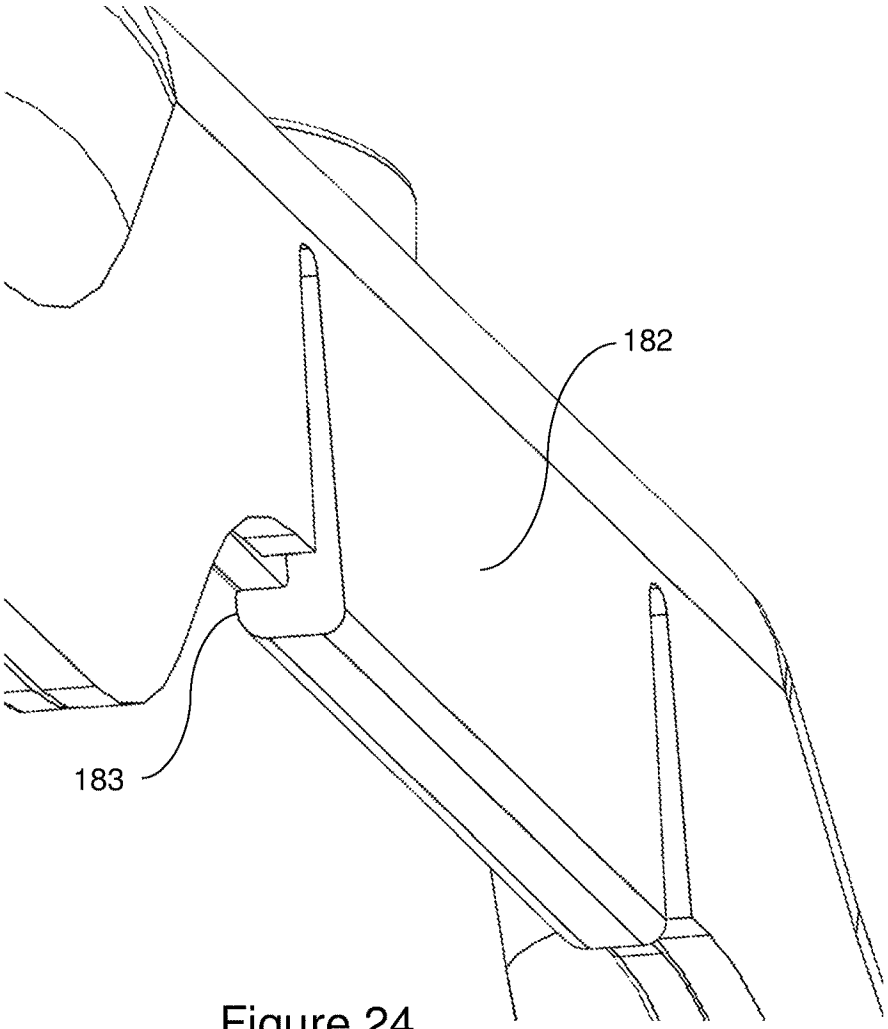
FIG. 24 is a close-up perspective view of the lid snap.
Figure 23:
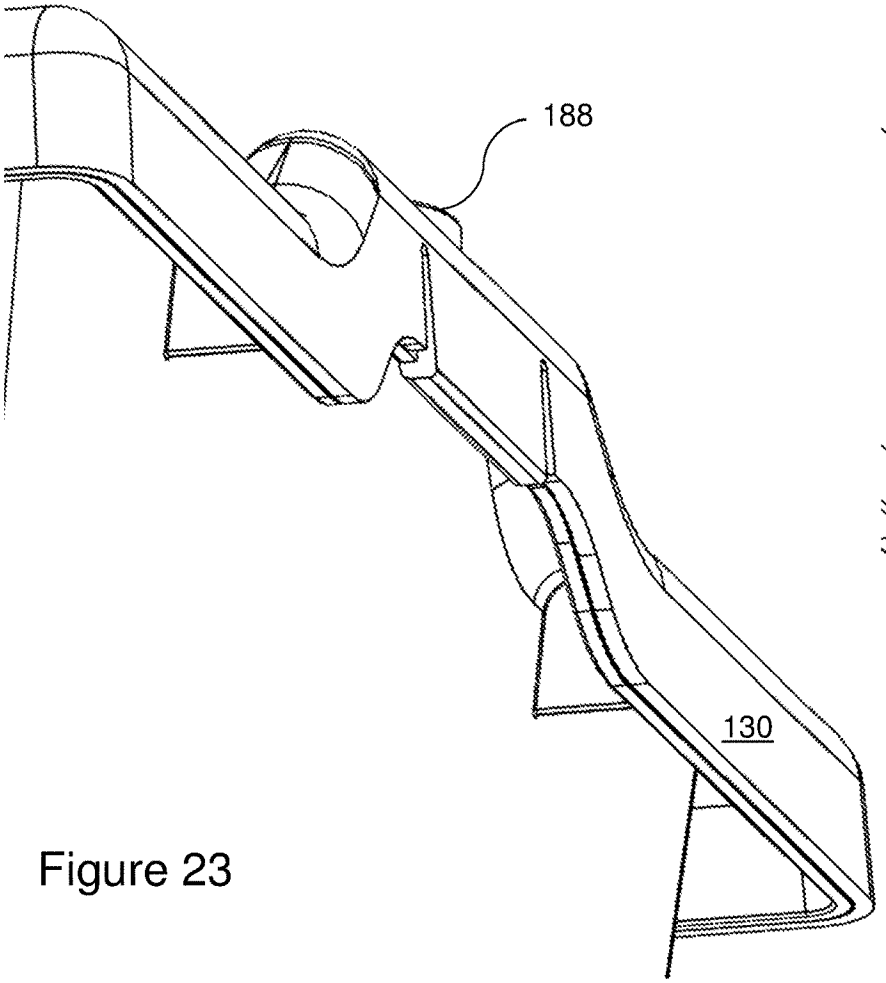
FIG. 23 is an alternative perspective view from below of the same handle section of the sink assembly.
Figure 25:
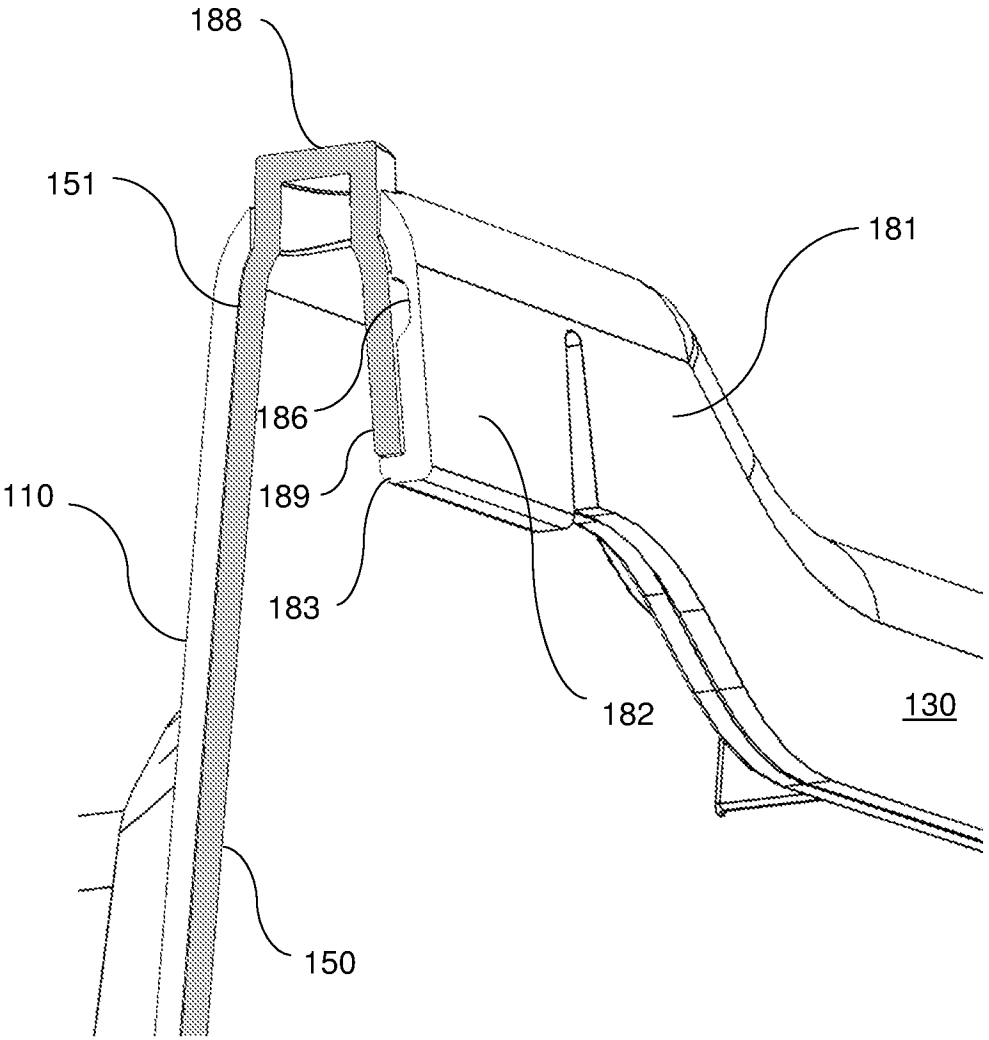
FIG. 25 is a close-up cross-sectional view of the handle section of the portable sink.

In further embodiments, a mirror slot may be provided along the back portion of the sink 100. In one example, a slot 140 (FIGS. 16 and 17) may be formed by a longitudinal depression 142 in the rim 151, optionally equipped with one or a series of spaced apart drainage openings 144, positioned under the slot 138 of the rim 130 of the container lid 110. An edge of a flat mirror 108 may be positioned and retained inside the slot 140 (see FIG. 19). A mirror 108 attached to the sink 100 and facing the user may further enhance the user experience with the portable sink 100.

In use, the portable sink 100 may be positioned on a table, or another suitable flat surface and the clean water section 152 may be filled with clean water. The lid 110 may be securely placed over the container 150 and the water dispenser assembly 120 may be positioned on top of the tapered head 112 with the water intake hose 122 submerged into the clean water section 152. Activation of the electrical water pump would cause the water to be drawn into the water dispensing assembly 120, which then causes pouring of the water into the basin 118. Used water is then collected over the drainage opening 115 and drained by gravity into the used water section 154. Once all the clean water is used up, the portable sink 100 may be transported to a location where the used water may be drained, the drainage opening 155 of the used water section 154 may be opened by removing the drainage plug 170 so that the used water may be discarded. The container 150 may be rinsed or cleaned and then the use of the sink 100 may be repeated as described briefly above.

An alternative embodiment of the portable sink assembly 100 is illustrated in FIGS. 19-26. The alternative embodiment differs from the previous embodiment in two aspects: the presence of the two symmetrical raised handles 180 on the left side and the right side of the sink assembly 100 as well as the alternative design for a sealing protrusion 136 defining the seal between the container lid and the middle partition 156 to separate clean water from the used water, as already mentioned above.

The presence of two symmetrical handles 180 on both sides of the sink assembly allows for easy lifting and transporting the sink assembly, as well as for securing the container lid 110 over the container 150 as described below in greater detail.

A close-up of the right handle 180 is seen in FIGS. 20 through 25. The raised handle 180 includes a raised portion 181 of the container lid rim 130 sized and shaped to be positioned over a corresponding raised portion 187 of the container rim 151, which is therefore nested within the raised portion 181. In turn, the raised portion 181 features a locking snap 182 and a top opening 185. The locking snap 182 may have a lip 183 to engage with a corresponding edge 189 of the rim 151. The length of the snap 182 may be selected to generally correspond to the width of a human palm to facilitate a convenient engagement and disengagement of the snap 182 to and from the edge 189 of the container rim 151. To facilitate moving the lip 183 in and out of the engagement with the edge 189, a living hinge 186 may be made as an undercut above the lip 183. A thumb rest 188 may be made as part of the container rim 151, which may protrude through the opening 185 when the container lid 110 is placed over the container 150. To disengage the lid 110 from the container 150, a user may place both hands on the raised handles 180, pull the snaps 182 away from the container, and use the thumbs to push down on the thumb rests 188—therefore facilitating unlocking and lifting the lid 110 up and away from the container 150.

Figure 27:
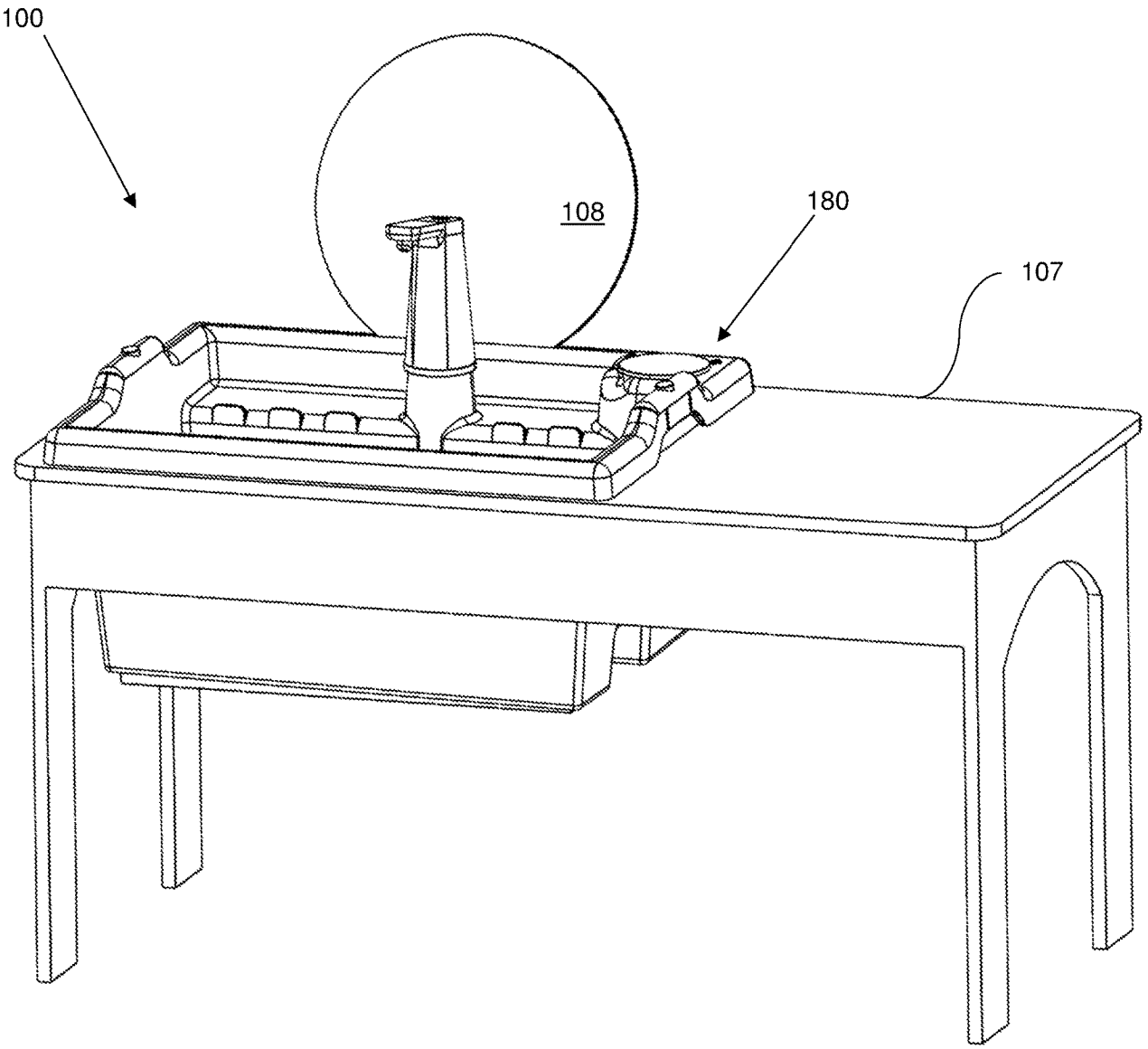
FIG. 27 is a perspective view of the portable sink placed within an exemplary supporting frame.

Finally, a number of accessories may be provided with the portable sink 100 to form a kit associated therewith. In addition to the optional mirror 108, the portable sink 100 may be supplied with a supporting stand, such as a table 107 or another suitable support frame as seen in FIG. 27. The supporting stand may be equipped with wheels for easy transport of the portable sink 100. The table 107 may have a generally rectangular top opening on the top surface thereof which is sized to accept the portable sink therein, such that the container 150 protrudes down and into the opening. Other designs of a supporting stand may have a top opening made as a rectangular frame sized to accept the container 150 therein. Container rim 151 serves as a stop limiting the protrusion of the portable sink 100 into the top opening of the table 107. Once positioned in the opening, the portable sink 100 may be placed to make the container rim 151 to be flush with the table 107. Using the sink design with a pair of symmetrical raised handles 180 is especially advantageous for this configuration as it facilitates placing the portable sink 100 into and lifting the portable sink out of the table opening—since the raised handles are located away and above the table surface hiving a convenient opening for the hands of the user.

It is contemplated that any embodiment discussed in this specification can be implemented with respect to any method of the invention, and vice versa. It will be also understood that particular embodiments described herein are shown by way of illustration and not as limitations of the invention. The principal features of this invention can be employed in various embodiments without departing from the scope of the invention. Those skilled in the art will recognize, or be able to ascertain, using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference. Incorporation by reference is limited such that no subject matter is incorporated that is contrary to the explicit disclosure herein, no claims included in the documents are incorporated by reference herein, and any definitions provided in the documents are not incorporated by reference herein unless expressly included herein.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12, 15, 20 or 25%.

All of the devices and/or methods disclosed and claimed herein can be made and executed without undue experimentation in light of the present disclosure. While the devices and methods of this invention have been described in terms of preferred embodiments, it will be apparent to those of skill in the art that variations may be applied to the devices and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A portable sink assembly comprising:

a pump and water dispenser assembly having an inlet hose;

a single-piece container with an open top, the container is divided into a clean water section and a used water section by a middle partition, the container with a width greater than a length thereof, the middle partition oriented along the width of the container from a left side of the container to a right side thereof; the clean water section is located further away than the used water section when facing a user; and a single-piece detachable container lid with a built-in basin extending downward therefrom, the container lid is configured to cover the container when placed over the top end thereof, the container lid further comprising a water intake protrusion positioned over the clean water section of the container and configured to accept the pump and water dispenser assembly when placed over the water intake protrusion with the water inlet hose traversing therethrough and extending to the clean water section of the container, the basin further comprising a drainage opening located above the used water section of the container.

2. The portable sink assembly, according to claim 1, wherein the container further comprises a container rim along the open top thereof.

3. The portable sink assembly, as in claim 1, wherein the container and/or the container lid further comprises a pair of handles formed on both sides thereof.

4. The portable sink assembly, as in claim 3, further comprising a pair of symmetrical raised handles on both sides of the portable sink, each raised handle comprising a raised portion of the container rim nested within a corresponding raised portion of a container lid rim.

5. The portable sink assembly, as in claim 4, wherein each handle further comprises a locking snap configured to lock the container lid with the container upon assembling the portable sink together.

6. The portable sink assembly, as in claim 5, wherein each handle further comprises a thumb rest on the raised portion of the container rim protruding through an opening in the raised portion of the container lid rim and configured to facilitate separation of the container lid from the container when the locking snaps are released.

7. The portable sink assembly, as in claim 1, wherein the container defines a bottom slanted towards the middle partition from both sides thereof, thereby causing to retain more water adjacent to the middle partition in both the clean water section and the used water section of the container.

8. The portable sink assembly, as in claim 1, wherein the used water section is sized to have at least the same or greater internal volume than the clean water section.

9. The portable sink assembly as in claim 1, wherein the container further comprises a drainage opening with a removable plug located at the lowest portion of the used water section thereof and configured to facilitate removal and disposal of used water therefrom.

10. The portable sink assembly, as in claim 1, wherein at least one of the single-piece container or the single-piece container lid is made from plastic by thermoforming and/or injection molding.

11. The portable sink assembly, as in claim 1, further comprising a match-and-lock pair of elements with a first match-and-lock element formed as part of the single-piece container and the second match-and-lock element formed as part of the single-piece container lid, wherein the match-and-lock pair of elements are configured to allow only one way to position the container lid over the container.

12. The portable sink assembly, as in claim 1, wherein upon assembly of the container lid over the container, the middle partition of the container is engaged with at least one corresponding lid of the container lid to sealingly isolate the clean water section from the used water section.

13. A portable sink assembly comprising:

a pump and water dispenser assembly having an inlet hose;

a single-piece container with an open top, the container is divided into a clean water section and a used water section by a middle partition, and a single-piece detachable container lid with a built-in basin extending downward therefrom, the container lid is configured to cover the container when placed over the top end thereof, the container lid further comprising a sealing protrusion extending toward the middle partition and forming a seal therewith upon assembling the container lid onto the container to separate the clean water section from the used water section.

14. The portable sink assembly, as in claim 13, wherein the single-piece container lid further comprises a plurality of parallel sealing protrusions configured to seal against the middle portion when the container lid is assembled with the container.

15. The portable sink assembly, as in claim 13, wherein at least one sealing protrusion further comprises a compressible gasket facing the middle partition to enhance the seal between the container lid and the container.

16. A kit for use with a portable sink assembly, the kit comprising:

a portable sink assembly comprising a pump and water dispenser, a single-piece container with an open top surrounded by a container rim, the container is divided into a clean water section and a used water section, a single-piece detachable container lid with a built-in basin extending downward therefrom, the container lid is configured to cover the container when placed over the container rim, the container lid further comprising a water intake protrusion configured to accept the pump and water dispenser assembly to provide water from the clean water section of the container, the basin further comprising a drainage opening located above the used water section of the container, a supporting stand having a top opening sized to accept the portable sink assembly therethrough to have the container rim flush with the table when the portable sink is placed in and supported by the table.

17. The kit for use with a portable sink assembly as in claim 16 further comprising a flat mirror placed into and retained by a longitudinal depression formed along one side of the container rim.

18. The kit for use with a portable sink assembly as in claim 16, wherein the portable sink further comprising a pair of symmetrical raised handles on both sides thereof to be above and away from the supporting stand when the portable sink is placed therein, wherein the pair of raised handles facilitates lifting of the portable sink assembly from the top opening of the supporting stand.

* * * * *